US010925417B2

(12) United States Patent
Sato et al.

(10) Patent No.: US 10,925,417 B2
(45) Date of Patent: Feb. 23, 2021

(54) SECURE HOLD HOOK

(71) Applicant: CCL Label, Inc., Framingham, MA (US)

(72) Inventors: Jay Sato, Mission Viejo, CA (US); Eric Cushing, Riverside, CA (US); Sujith Chacko, Arcadia, CA (US); Alan Jameson, West Covina, CA (US)

(73) Assignee: CCL LABEL, INC., Framingham, MA (US)

( * ) Notice: Subject to any disclaimer, the term of this patent is extended or adjusted under 35 U.S.C. 154(b) by 301 days.

(21) Appl. No.: 14/160,835

(22) Filed: Jan. 22, 2014

(65) Prior Publication Data

US 2015/0201764 A1 Jul. 23, 2015

(51) Int. Cl.
*A47G 1/17* (2006.01)
*A47G 1/20* (2006.01)

(52) U.S. Cl.
CPC ..... *A47G 1/17* (2013.01); *A47G 1/175* (2013.01); *A47G 1/20* (2013.01)

(58) Field of Classification Search
CPC ..... A47G 1/17; F16M 13/022
USPC ..... 248/205.4
See application file for complete search history.

(56) References Cited

U.S. PATENT DOCUMENTS 2,751,807 A 6/1956 Harre
2,765,998 A * 10/1956 Engert ..... A47G 1/17 248/205.3
3,311,339 A * 3/1967 Frye ..... A47G 1/17 206/460
3,409,257 A * 11/1968 Elm ..... F16L 3/08 248/205.3
3,885,723 A * 5/1975 Magnie ..... A47G 25/1457 223/98
4,026,510 A * 5/1977 Holmes ..... A47G 1/20 24/698.1
4,300,692 A * 11/1981 Moreno ..... A47F 5/0853 211/87.01
4,317,554 A * 3/1982 Winger ..... A47G 1/17 248/205.3
4,457,053 A * 7/1984 Niwa ..... F16L 3/12 24/304
4,671,480 A 6/1987 Frye
5,121,896 A * 6/1992 Frye ..... F16B 47/003 248/205.3
D339,058 S 9/1993 Greenhut et al.
(Continued)

FOREIGN PATENT DOCUMENTS

DE 9108687 U1 * 9/1991 ..... A47G 1/17
DE 10213924 A1 * 10/2002 ..... A47G 1/17
(Continued)

*Primary Examiner* — Jeanette E Chapman
(74) *Attorney, Agent, or Firm* — McDonald Hopkins LLC

(57) ABSTRACT

A secure hold hook is shown and described. The secure hold hook may include a body having first and second portions and a pair of opposed surfaces, a hook monolithically formed with the body, the hook extending from a first of the pair of opposed surfaces and a first adhesive adhered with a second of the pair of opposed surfaces. The secure hold hook may also include a second adhesive extending from the first adhesive, and a hinge positioned between the first and second portions, the hinge configured to permit the first and second portions to pivot with respect to one another.

18 Claims, 8 Drawing Sheets

(56) References Cited

U.S. PATENT DOCUMENTS 5,255,800 A 10/1993 Kelly
5,259,519 A 11/1993 Lieberman
5,399,409 A 3/1995 Whiteman
5,409,189 A 4/1995 Luhmann
5,433,152 A 7/1995 Henry
5,433,413 A 7/1995 Adams
5,433,804 A 7/1995 Nottingham et al.
5,462,782 A 10/1995 Su
5,482,242 A 1/1996 Jegelius
5,484,066 A 1/1996 Luisi
5,494,250 A 2/1996 Chen
5,507,464 A 4/1996 Hamerski et al.
5,553,719 A 9/1996 Campbell
5,593,120 A 1/1997 Hamerski
5,718,402 A 2/1998 Hoffman et al.
5,738,325 A * 4/1998 Brown ..... G06F 3/0395 248/205.3
5,848,772 A 12/1998 Fitzgerald
5,909,758 A 6/1999 Kitamura
5,964,437 A 10/1999 Belokin et al.
5,967,474 A 10/1999 doCanto et al.
5,979,675 A * 11/1999 Moriarty ..... B01L 9/54 211/119.003
5,984,247 A 11/1999 Luhmann et al.
5,989,708 A * 11/1999 Kreckel ..... A47G 1/175 248/205.3
D417,385 S 12/1999 Bries et al.
6,001,471 A 12/1999 Bries et al.
6,070,536 A 6/2000 Cinkaj
6,082,686 A 7/2000 Schumann
6,095,465 A 8/2000 Week et al.
6,106,937 A 8/2000 Hamerski
6,120,867 A 9/2000 Hamerski et al.
6,131,864 A 10/2000 Schumann
6,162,534 A * 12/2000 Hamerski ..... C09J 7/0225 248/205.3
6,187,404 B1 2/2001 Schumann
6,325,342 B1 12/2001 Dignat
6,403,206 B1 6/2002 Bries et al.
6,406,781 B1 6/2002 Hamerski
6,431,508 B1 8/2002 Courson et al.
6,447,196 B1 * 9/2002 Arkwright ..... B42F 11/00 281/21.1
6,458,454 B1 10/2002 Kreckel
6,467,742 B1 10/2002 Pitcher
6,527,900 B1 3/2003 Kreckel et al.
6,572,063 B1 6/2003 Gitelman et al.
6,616,790 B2 9/2003 Luhmann et al.
D480,292 S * 10/2003 Johansson ..... D8/367
6,722,501 B2 4/2004 Hamerski et al.
D494,452 S * 8/2004 Sheldon ..... D8/367
6,808,149 B1 10/2004 Sendowski et al.
6,835,452 B1 12/2004 Hamerski
6,976,595 B1 12/2005 Geller
D530,192 S * 10/2006 Becerra ..... D8/395
7,216,841 B2 5/2007 Dodig, Jr.
D543,837 S 6/2007 Newbould et al.
D554,481 S 11/2007 Newbould et al.
D554,483 S * 11/2007 Hager ..... D8/367
D572,121 S 7/2008 Shiffler
7,448,582 B2 11/2008 Jackson
7,464,907 B1 12/2008 Lane
D584,939 S 1/2009 Snell
D603,688 S 11/2009 Chiu
D609,995 S * 2/2010 Hager ..... D8/367
7,807,007 B2 * 10/2010 Tachauer ..... A44B 18/0049 156/242
8,087,180 B1 1/2012 Clayton
D665,653 S 8/2012 Thompson et al.
D678,041 S 3/2013 Pan et al.
D680,804 S * 4/2013 Gilboe ..... D7/367
D682,663 S * 5/2013 Evon ..... D8/367
D697,388 S * 1/2014 Pan ..... D8/367
D697,389 S 1/2014 Pan
D714,621 S * 10/2014 Pan ..... D8/367
D714,622 S * 10/2014 Pan ..... D8/367
9,052,056 B1 * 6/2015 Shea ..... F16M 13/022
D805,374 S * 12/2017 Shoenhair ..... D8/367
9,920,783 B2 * 3/2018 Runge ..... F16B 11/006
2001/0028022 A1 10/2001 Hamerski et al.
2002/0017359 A1 2/2002 Luhmann
2002/0036253 A1 3/2002 Lake
2002/0081409 A1 6/2002 Shaffer
2002/0121581 A1 9/2002 Franck et al.
2002/0166874 A1 11/2002 DeVaux
2003/0033771 A1 2/2003 Anderson
2003/0034315 A1 2/2003 Tayebi
2003/0047654 A1 3/2003 Johansson et al.
2003/0121871 A1 7/2003 Zadro
2003/0211317 A1 11/2003 Sheridan et al.
2004/0016665 A1 1/2004 Kellaway
2004/0020883 A1 2/2004 Brokaw
2004/0084597 A1 5/2004 Hamerski
2004/0098875 A1 5/2004 Gould
2004/0123503 A1 7/2004 Pitzen
2004/0131815 A1 7/2004 Maggio et al.
2004/0188580 A1 9/2004 Ryu et al.
2004/0206867 A1 10/2004 Zhadanov
2005/0056756 A1 3/2005 Wang
2005/0139739 A1 * 6/2005 Hamerski ..... F16B 2/005 248/206.5
2005/0163959 A1 7/2005 Cross et al.
2005/0210695 A1 9/2005 Muday et al.
2005/0247841 A1 11/2005 Brooks
2006/0021272 A1 2/2006 Kleissler et al.
2006/0054771 A1 3/2006 Lie
2006/0068144 A1 3/2006 Mizuno et al.
2006/0124811 A1 6/2006 Tatarsky et al.
2006/0156679 A1 7/2006 Pierret
2006/0243880 A1 11/2006 Lane
2007/0029355 A1 2/2007 Dente, Jr.
2007/0096003 A1 * 5/2007 Kuo Liao ..... A47G 1/17 248/467
2007/0102601 A1 5/2007 Thompson
2007/0207311 A1 9/2007 Klauck et al.
2007/0257165 A1 11/2007 Newbould et al.
2007/0295436 A1 12/2007 Joseph
2007/0295879 A1 12/2007 Wong
2008/0035818 A1 2/2008 Sheffield et al.
2008/0053345 A1 3/2008 Newbould et al.
2008/0053931 A1 3/2008 Newbould et al.
2008/0053934 A1 3/2008 Newbould et al.
2008/0296244 A1 12/2008 Tomassetti
2009/0039225 A1 2/2009 Taylor
2009/0200253 A1 8/2009 Sandow
2009/0205784 A1 8/2009 Sudo et al.
2009/0242712 A1 10/2009 Thomspon
2010/0018082 A1 * 1/2010 Stokes ..... A43B 7/16 36/36 R
2010/0050398 A1 3/2010 Gokey
2010/0102182 A1 4/2010 Lin
2010/0155565 A1 6/2010 Bernstein
2010/0314511 A1 12/2010 Hutter, III
2011/0024585 A1 2/2011 Brinkdopke et al.
2011/0031198 A1 2/2011 Trettin et al.
2011/0056896 A1 3/2011 Tzekova et al.
2011/0089226 A1 4/2011 Morrison
2011/0101188 A1 5/2011 Groepler
2011/0146126 A1 6/2011 Phillips
2011/0174940 A1 7/2011 Cai
2011/0220295 A1 9/2011 Krawinkel et al.
2011/0290965 A1 12/2011 Virgin
2012/0009548 A1 * 1/2012 Feit ..... G09F 5/042 434/95
2012/0032043 A1 2/2012 McGreevy et al.
2012/0056051 A1 3/2012 Gold
2012/0112022 A1 5/2012 Cheng
2012/0132602 A1 5/2012 Millspaugh
2012/0145847 A1 6/2012 Wang
2012/0153102 A1 6/2012 Thompson
2012/0164914 A1 6/2012 O'Connor et al.
2012/0183714 A1 7/2012 Peng
2012/0187260 A1 7/2012 Moyer

(56) References Cited

U.S. PATENT DOCUMENTS

| | | | |
|---|---|---|---|
| 2012/0187270 | A1 | 7/2012 | Haarlander et al. |
| 2012/0202035 | A1 | 8/2012 | Xie et al. |
| 2012/0233932 | A1 | 9/2012 | Kharchenko et al. |
| 2012/0246900 | A1 | 10/2012 | Shimmel et al. |
| 2012/0298809 | A1 | 11/2012 | Preedy |
| 2012/0314353 | A1 | 12/2012 | Williams |
| 2013/0025929 | A1 | 1/2013 | Dower et al. |
| 2013/0026319 | A1 | 1/2013 | Crescenzo |
| 2013/0056598 | A1 | 3/2013 | Ghiorghie |
| 2013/0062482 | A1 | 3/2013 | Wang |
| 2013/0068712 | A1 | 3/2013 | Kwok et al. |
| 2013/0075552 | A1 | 3/2013 | Kenney et al. |

FOREIGN PATENT DOCUMENTS

| | | | | |
|---|---|---|---|---|
| EP | 0838182 | | 12/2005 | |
| WO | WO199301742 | | 2/1993 | |
| WO | WO199421157 | | 9/1994 | |
| WO | WO199509548 | | 4/1995 | |
| WO | WO200033708 | | 6/2000 | |
| WO | WO200134001 | | 5/2001 | |
| WO | WO200233274 | | 4/2002 | |
| WO | WO2003070068 | | 8/2003 | |
| WO | WO2004024467 | | 3/2004 | |
| WO | WO2005052388 | | 6/2005 | |
| WO | WO2006097042 | | 9/2006 | |
| WO | WO2006097282 | | 9/2006 | |
| WO | WO 2006097282 | A1 * | 9/2006 | ..... A47G 1/17 |
| WO | WO2007013067 | | 2/2007 | |
| WO | WO 2007013067 | A2 * | 2/2007 | ..... A47G 1/17 |
| WO | WO2007016733 | | 2/2007 | |
| WO | WO2007075771 | | 7/2007 | |
| WO | WO2007123784 | | 11/2007 | |
| WO | WO2007144726 | | 12/2007 | |
| WO | WO2008030816 | | 3/2008 | |
| WO | WO2008122902 | | 10/2008 | |
| WO | WO2010040425 | | 4/2010 | |
| WO | WO2011000469 | | 1/2011 | |
| WO | WO201162998 | | 12/2011 | |
| WO | WO2012017292 | | 2/2012 | |
| WO | WO2012078085 | | 6/2012 | |
| WO | WO2012084476 | | 6/2012 | |
| WO | WO2012120268 | | 9/2012 | |
| WO | WO2013032114 | | 3/2013 | |

* cited by examiner

SECURE HOLD HOOK

FIELD OF USE

The present invention is generally related to a removable secure hold hook and, more particularly, to a removable secure hold hook capable of removal with minimal to no damage to a surface to which the secure hold hook selectively attaches.

BACKGROUND

It is often desirable to attach, engage or hang items to surfaces such as walls, columns, windows, etc. One common manner of attaching items to a wall includes hammering a nail into a wall and hanging the item from the nail. Another common manner of attaching items to a wall includes inserting a nail into an aperture in a hook and hammering the nail into the wall and hanging the item from the hook. One drawback to these approaches is that upon moving the item or otherwise removing it from the wall, a large hole is often left in the wall.

Further, users often wish to temporarily attach an item to a surface and do not desire to hammer a nail into the surface. This is often occurs while seasonally decorating a space. Hooks with adhesives have been used to overcome some of the aforementioned shortcomings. However, these hooks with adhesives have other shortcomings. One common problem is that when removing these hooks with adhesive, the surface to which it is adhered may become damaged. One manner of attempting to avoid this problem is those hooks with adhesives that require deformation of the adhesive to remove it from the surface to which it is adhered. For example, a user often must pull or otherwise deform the adhesive to release such from the surface to which it is adhered.

This design, however, has many drawbacks and issues. For example, the hook may snap-back and hit the user, the adhesive may break when being pulled, which may require the user to pry the hook from the surface, which may damage the surface to which it is attached. Further, these hooks are often very thick and bulky. This may make the use of the hook undesirable to use or even unable to be used to attach certain items to a surface. Further, attaching the hook with adhesive only may limit the amount of weight of the item to which may be attached to the hook. This may further limit the use of the hook with adhesive.

Therefore, there is a need for an improved hook with adhesive that may attach to a surface to hold an item on the surface. There is further a need for the hook with adhesive to have a modest profile and that results in little to no damage when being removed from the surface to which it is attached. Further, there is a need for a hook with adhesive that includes an additional engaging member such that the hook with adhesive is able to withstand additional forces and remain in an operative position.

SUMMARY

A secure hold hook is shown and described. The secure hold hook may include a body having first and second portions and a pair of opposed surfaces, a hook monolithically formed with the body, the hook extending from a first of the pair of opposed surfaces and a first adhesive adhered with a second of the pair of opposed surfaces. The secure hold hook may also include a second adhesive extending from the first adhesive, and a hinge positioned between the first and second portions, the hinge configured to permit the first and second portions to pivot with respect to one another.

A secure hold hook may include a body having first and second opposed surfaces and top and bottom portions, a hook attached with the body, at least a portion of the hook extending from the first surface, and a first adhesive attached with the second surface. The secure hold hook may also include a second adhesive extending from the first adhesive, and a hinge positioned between the top and bottom portions, the hinge configured to permit the top and bottom portions to pivot with respect to one another.

A secure hold hook may include a body having top and bottom portions, a hinge positioned between the top and bottom portions, where the top portion is pivotable with respect to the bottom portion at the hinge, and a hook monolithically formed with the body, the hook extending from the body in a first direction. The secure hold hook may also include a first adhesive adhered with the body, a second removable adhesive extending from the first adhesive, and an engagement member positioned at the top portion of the body and extending away from the body in a second direction, where the first direction is opposite the second direction.

BRIEF DESCRIPTION OF THE DRAWINGS

The invention may be better understood by reference to the following detailed description taken in connection with the following illustrations, wherein.

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

FIGS. 1-7 depict an embodiment of a secure hold hook 20. The secure hold hook 20 may be configured to selectively attach to an appropriate surface, including, without limitation, drywall, wood, plastic, rubber, cork, and any combination of such. The secure hold hook 20 may be configured to be selectively removed from the appropriate surface with little to no damage resulting to the appropriate surface, as described in more detail below. The secure hold hook 20 may be of any appropriate configuration and is not limited to that shown and described herein. By way of a non-limiting example, the secure hold hook 20 may include a body 24. The body 24 may be of any appropriate shape and size, such as by way of a non-limiting example, being generally planar. The body 24 may be generally thin, i.e., it may have a thickness T that is between approximately 0.03 and 0.07 inches. It should be understood, however, that the body 24 may be of any appropriate thickness and is not limited to that described herein.

The body 24 may be elongated such that it may be longer than it is wide, i.e., it may extend more longitudinally than it does laterally. However, the present teachings are not limited to this configuration. By way of a non-limiting example, the body 24 may be approximately 1.25 to 4 inches in length L and may be approximately 0.5 to 1.75 inches in width W. It should be understood, however, that these dimensions are merely exemplary and the present teachings are not limited to the body 24 being of these dimensions. The body 24 may be formed of any appropriate material, including, without limitation, plastic, metal, rubber or any combination of such. Further, the body 24 may be monolithically formed or formed through subsequent operations.

Figure 1:
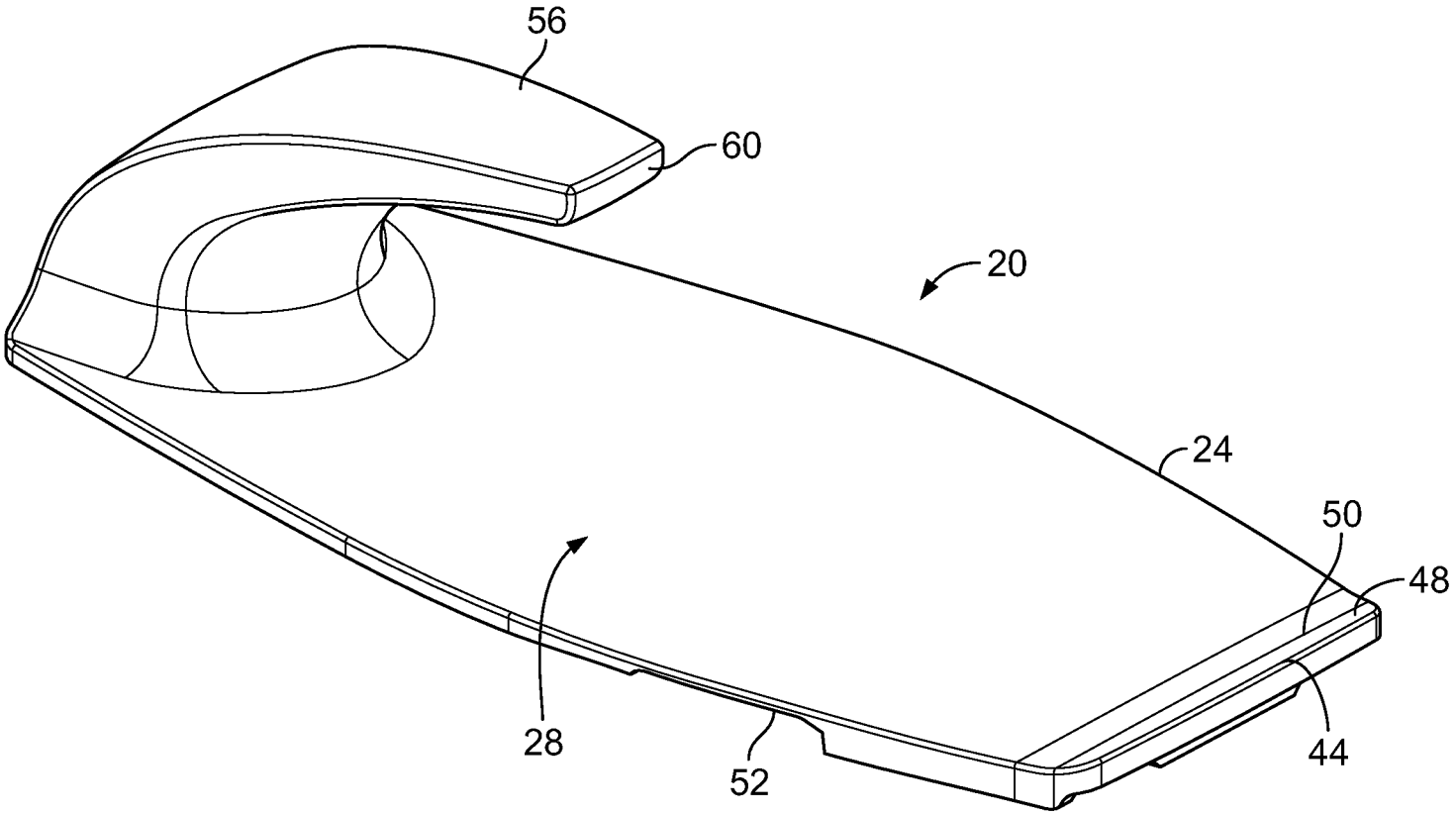
FIG. 1 is a perspective view of an embodiment of a secure hold hook.
Figure 1A:
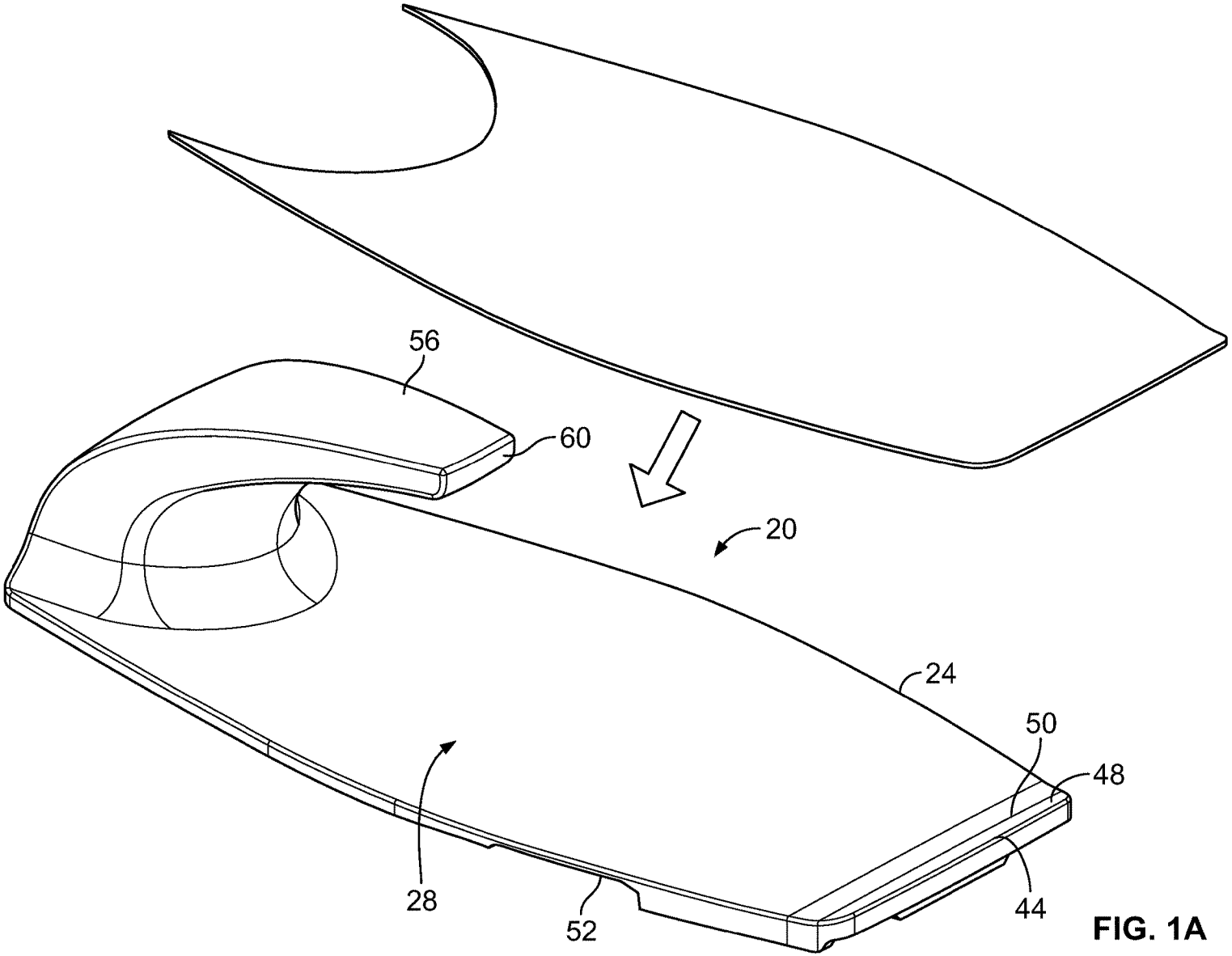
FIG. 1A is a perspective view of an embodiment of a secure hold hook with a member in a partially exploded view.
Figure 2:
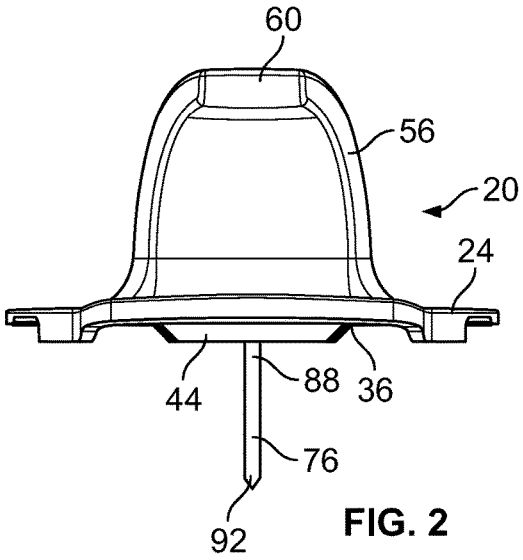
FIG. 2 is a top view of the secure hold hook.
Figure 6:
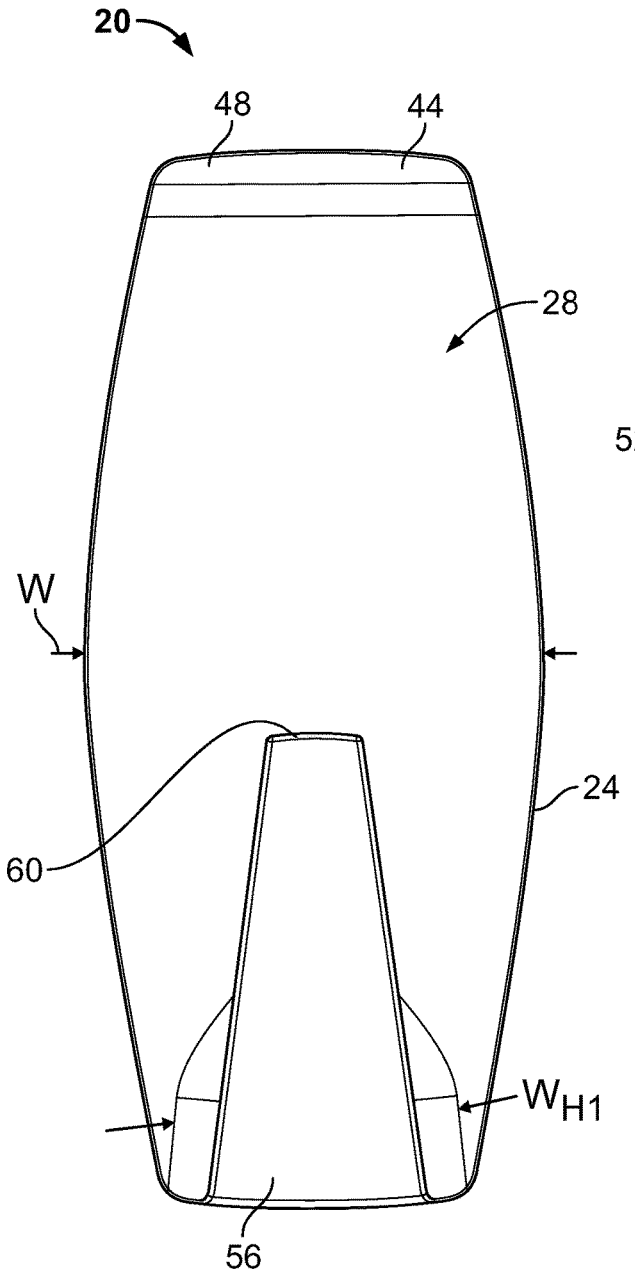
FIG. 6 is a front view of the secure hold hook.

The body 24 may include a first surface 28 and a second surface 32. At least a portion of the first surface 28 may be generally planar as shown in FIG. 6—further, the entire first surface 28 may be generally planar. The first surface 28 may extend outward when the secure hold hook 20 is operatively secured with the appropriate surface. The first surface 28 being generally planar may permit a cover or such other decorative member 30 to be selectively attached with the secure hold hook 20, such as shown in FIG. 1A. The decorative member 30 may be of any appropriate configuration. By way of a non-limiting example, the decorative member 30 may be selectively attached with the first surface 28—it may be configured to be selectively attached with a portion of the first surface 28 or the entire first surface 28. The decorative member 30 may be attached in any manner. The decorative member 30 may include a removable adhesive that may selectively attach with the first surface 28. The adhesive may be of a configuration such that the user may remove the decorative member 30 and either leave the secure hold hook 20 as is or add another decorative member 30. Further, the decorative member 30 may be selectively attached through static cling. The decorative member 30 may include any appropriate decorative finish. For example, it may be a wood grain finish, a metal or metallic finish, a brick finish, a stone finish, any variety of color with any appropriate finishes (e.g., matte, egg shell, etc.). The decorative member 30 may include a relatively thin membrane that includes a decorative finish on one side and either adhesive or a static cling finish to selectively and removably attach with the first surface 28.

Figure 7:
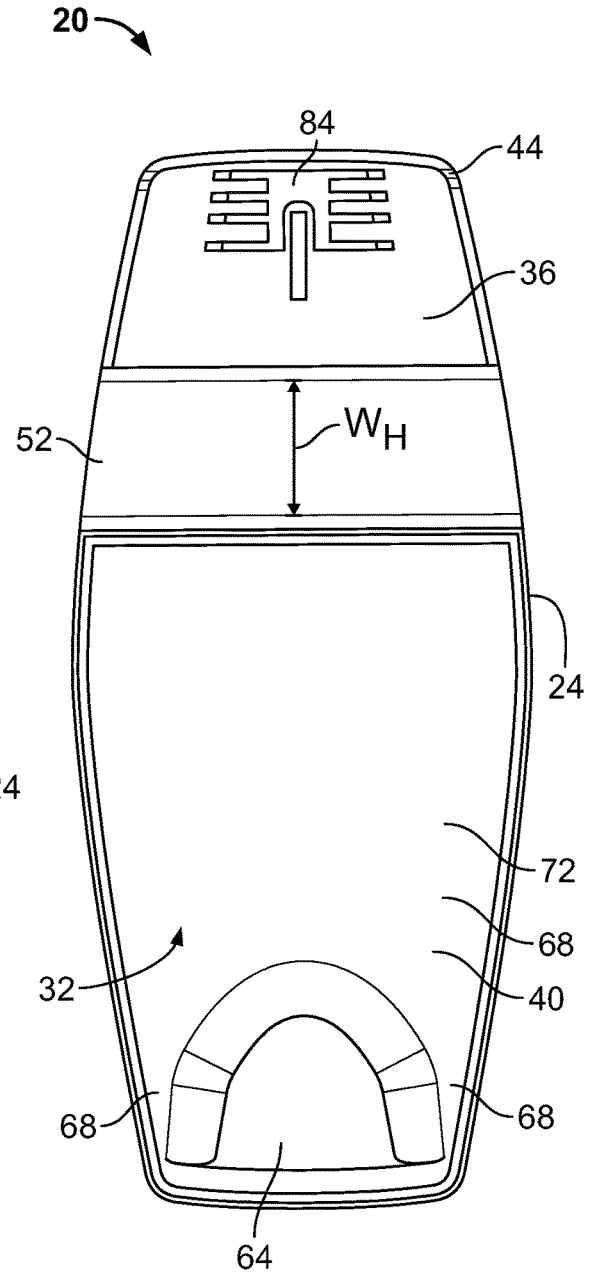
FIG. 7 is a rear view of the secure hold hook.
Figure 7A:
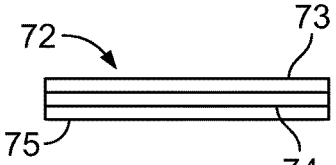
FIG. 7A is a side view of a portion of the adhesive of the secure hold hook of FIG. 1.

The second surface 32 may extend inward toward the appropriate surface when the secure hold hook 20 is operatively secured with the appropriate surface. As shown in FIG. 7, at least a portion of the second surface 32 may be generally planar—further, the entire second surface 32 may be generally planar. The body 24 may also include a top portion 36 and a bottom portion 40 as shown for example in FIG. 7.

An indicator 44 may be positioned on the top portion 36 on the first surface 28 of the body 24. The indicator 44 may provide an indication or guide to the user as how the secure hold hook 20 may be selectively removed from the surface to which it is attached, as described in more detail below. The indicator 44 may be of any appropriate configuration and is not limited to that shown. By way of a non-limiting, the indicator 44 may include a tab 44 that extends from the top portion 36 and first surface 28. The tab 44 may include a grasping portion 48 that may assist the user in grasping the tab 44 such as to remove the secure hold hook 20 from the applicable surface. The grasping portion 48 may be of any appropriate configuration. By way of a non-limiting example, the grasping portion 48 may include a plurality of raised ridges 50 that extend from the tab 44, such as the two raised ridges shown in FIGS. 1 and 6. Further, the grasping portion 48 may be depressed ridges, detents, nubs, knurled surface, or may be of any appropriate configuration such that may assist a user with grasping.

Figure 4:
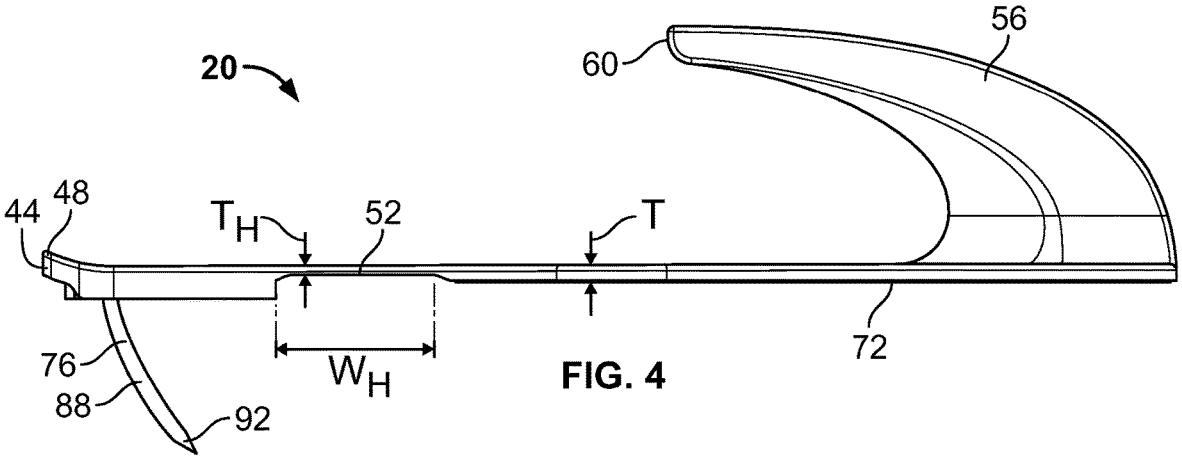
FIG. 4 is a first elevation view of the secure hold hook.
Figure 5:
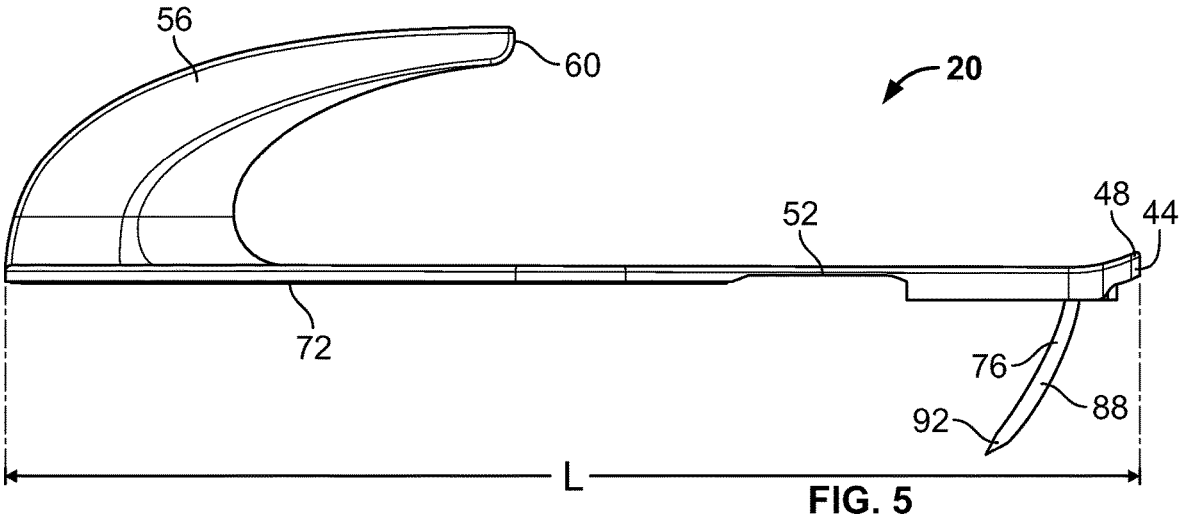
FIG. 5 is a second elevation view of the secure hold hook.

The secure hold hook 20 may include a hinge 52 that may be in any appropriate position on the body 24. By way of a non-limiting example, the hinge 52 may be generally positioned between the top and bottom portions 36, 40 of the body 24. Further, the hinge 52 may be adjacent to or in proximity to the grasping portion 48. The hinge 52 may be of any appropriate configuration. As shown in FIGS. 4 and 7, the hinge 52 may have a width $W_H$ of approximately between 0.15 and 1.75 inches, which may result in the hinge 52 being between 4% and 19% of the length L of the body 24. The extra-wide hinge 52 may spread the curvature of the hinge 52 over a wider area generally preventing a large bend of material. This may prevent weakening of the body 24, and may prevent whiting that may otherwise occur with hinges. This may extend the lifecycle of the body 24 and ultimately the lifecycle of the secure hold hook 20—and may maintain a positive aesthetic appearance.

The hinge 52 may be any appropriate configuration—the hinge 52 may be configured such that the top portion 36 of the body 24 pivots or bends relative to the bottom portion 40 of the body 24. By way of a non-limiting example, the hinge 52 may be a living hinge, i.e., it may be monolithically formed with the body 24. The hinge 52 may have a thickness $T_H$ that is thinner than either or both of the top 36 and bottom 40 portions T of the body 24. The thickness $T_H$ being less may form the living hinge. It should be understood, however, that the hinge 52 may be of any appropriate configuration and is not limited to that shown and described herein.

Further, the hinge 52 may extend at least a portion of the width W of the body 24. By way of a non-limiting example and as shown in FIG. 7, the hinge 52 may extend an entirety of the width W of the body 24. It should be understood, however, that the hinge 52 is not limited to this configuration. The hinge 52 may extend only a portion of the width W, e.g., a majority of the width W, such as a middle portion of the width W.

The secure hold hook 20 may include a hook 56 extending from the first surface 28 on the bottom portion 40 of the body 24. The hook 56 may be of any appropriate configuration and is not limited to that shown and described. The hook 56 may be monolithically formed with the body 24 or may be attached through a subsequent process, e.g., welding, adhering or fastening. The hook 56 may extend toward the top portion 36 of the body 24. As shown, the hook 56 may extend approximately one-third to one-half of the length of the body 24—although the present teachings are not limited to this configuration. The hook 56 may be configured to securely hold items on the secure hold hook 20; including, without limitation, pictures, decorations, décor, lights, jerseys, coats, shirts, memorabilia, and the like. The hook 56 may be of a construction such that its width at the location from which it extends from the body 24 is substantially the majority of the width W of the body 24. As shown in FIG. 6, a width of the hook 56 $W_{H1}$ at the location from which it extends from the body 24 may be between about 50% and 100% of the width W of the body 24 at the bottom portion 40. The hook 56 may get extend generally upward and away from the bottom portion 40 of the first surface 28. The hook 56 may get thinner as it extends upward and away from the bottom portion 40 of the first surface 28. An end portion 60 of the hook 56 may be a generally flat terminating end. The hook 56 may be of a configuration such that items may be selectively and operatively engaged with the hook 56 to hold items to the surface to which the secure hold hook 20 is selectively attached—the operation is very simple and easy. Further, the decorative member 30 mentioned above may include an aperture through which the hook 56 may pass when being selectively attached with the secure hold hook 20. Alternatively, the decorative member 30 may include a portion that may be selectively attached with the hook 56 in addition to the first surface 28—the decorative member 30 may selectively attach with a portion of the hook 56 or the entire hook 56.

The hook 56 may be generally hollow. This may reduce the overall weight of the secure hold hook 20—although the present teachings are not limited to the hook 56 being generally hollow. The hook 56 may instead by generally filled with a material of the hook 56 or the body 24 or both. The hook 56 may have an overall thickness to handle an appropriate amount of weight of the item so attached during use. By way of a non-limiting example, the secure hold hook 20 may be able to withstand an appropriate amount of weight when holding the item such that the secure hold hook 20 does not remove from the appropriate surface unless and until desired by the user.

The hook 56 being generally hollow may result in a cavity 64 being formed in the second surface 32 of the body 24. The cavity 64 may extend into the hook 56. A generally planar portion 68 may generally circumscribe the cavity 64 as shown in FIG. 7. The generally planar portion 68 may provide a surface to which an adhesive may be attached with the second surface 32 of the body 24 as explained in more detail below.

The secure hold hook 20 may include an adhesive 72 of any appropriate configuration. The adhesive 72 may be operatively attached with the second surface 32 at the bottom portion 40 of the body 24. The adhesive 72 may generally circumscribe the cavity 64—the adhesive 72 may be operatively attached with the planar portion 68 of the second surface 32. The adhesive 72 being operatively attached with the planar portion 68 may provide a good adhesion to the body 24. This may further provide support to the secure hold hook 20; especially at a location of the hook 56 operatively engaging an item. The planar portion 68 may provide a solid surface to which the adhesive 72 may adhere. Further, the planar portion 68 may similarly provide a solid surface to engage with the surface to which the secure hold hook 20 is selectively attached.

In some embodiments, the adhesive 72 may generally cover the entire bottom portion 40 of the second surface 32. In these embodiments, the adhesive 72 may extend from the planar portion 68 at the bottom portion 40 to the hinge 52. In other embodiments, the adhesive 72 may generally cover a majority of the bottom portion 40 of the second surface 32 to the hinge 52, which may constitute any portion of the majority portion of the bottom portion 40 of the second surface 32.

The adhesive 72 may include a first adhesive 73 that operatively attaches with the second surface 32 of the body 24. This first adhesive 73 may be a permanent adhesive of any appropriate configuration/formulation. The adhesive 72 may further include a second adhesive 74 that may operatively attach with the applicable surface to which the secure hold hook 20 is attached. The second adhesive 74 may comprise a removable adhesive of any appropriate configuration/formulation. By way of a non-limiting example, the adhesive 72 may include a double sided adhesive foam tape—such double-sided tapes are known to those of skill in the art and are available from Essentra Specialty Tapes of Forest Park, Ill., USA. The first adhesive 73 may comprise an extremely aggressive permanent adhesive on one side and the second adhesive 74 may comprise a removable adhesive on the other side. The removable side/second adhesive 74 may include a liner 75 configured to remove cleanly from the second adhesive 74 to expose the second adhesive 74 during operation of the secure hold hook 20. The second adhesive 74 may be configured to be cleanly removed from most hard, non-delaminating surfaces even after extended periods of time. The adhesive 72 may include a foam core (not shown) positioned between the first and second adhesives 73, 74, e.g., the foam core may be sandwiched between the first and second adhesives 73, 74.

In some embodiments, the adhesive 72 may include two removable adhesives 73, 74, which may be of similar configuration and formulation or may be of different configuration and formulation. In such embodiments, the first adhesive 73 may include a removable adhesive instead of the permanent adhesive described above. The first removable adhesive 73 may have less tacky adhesive than the second removable adhesive 74. In these embodiments, the user may remove the body 24 of the secure hold hook 20 from the first removable adhesive 73. The user may then remove the second removable adhesive 74 from the appropriate surface to which the secure hold hook 20 is selectively attached. Further still, the adhesive 72 may include two removable adhesives 73, 74 whereby the first adhesive 73 is tackier than the second adhesive 74 such that the user may remove the secure hold hook 20 by selectively detaching the second adhesive 74 from the appropriate surface. In such embodiments either or both of the first and second adhesives 73, 74 may be configured to be cleanly removed from most hard, non-delaminating surfaces even after extended periods of time.

The secure hold hook 20 may include an engaging member 76 configured to operatively secure a surface to which the secure hold hook 20 is attached. The engaging member 76 may provide an additional engaging feature in addition to the adhesive 72. The adhesive 72 in addition to the engaging member 76 may allow the secure hold hook 20 to be attached to a surface and withstand more forces than other prior art versions.

Figure 3:
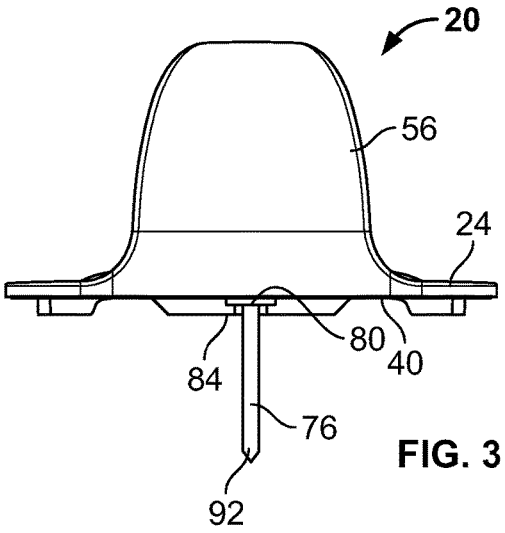
FIG. 3 is a bottom view of the secure hold hook.

The engaging member 76 may be coupled with the body 24 in any appropriate manner. By way of a non-limiting example, the engaging member 76 may be operatively engaged with the top portion 36 of the body 24. Specifically, the engaging member 76 may be operatively engaged with the second surface 32 of the body 24 at the top portion 36 in any appropriate manner such that it extends from the second surface 32 generally opposite the hook 56. As shown in FIG. 3, the engaging member 76 may include a fastener, such as a nail. The nail 76 may include a head 80. The head 80 may be operatively engaged with the top portion 36 of the body 24.

In some embodiments, the body 24 may be formed with the fastener 76 operatively secured therein, such as being co-molded therewith. This may generally prevent the fastener 76 from being removed from the body 24. During operation, the fastener 76 may not become disengaged from the body 24. This may make it easier for a user to manipulate the secure hold hook 20—as the fastener 76 is not generally removable from the body 24. In other embodiments, the fastener 76 may be removably attached with the body 24—the fastener 76 may be operatively and removably attached in any appropriate manner. The present teachings are not limited to the configuration shown and described. By way of a non-limiting example, the top portion 36 may include a groove 84 into which the head 80 of the fastener 76 may be operatively engaged, i.e., it may be selectively inserted into the groove 84. The engagement of the groove 84 and head 80 may generally prevent the fastener 76 from inadvertently removing or otherwise falling out of engagement with the body 24. In these embodiments, the fastener 76 may be replaced as necessary.

The fastener 76 may include a generally curved body 88 and a piercing end 92, such as the generally sharpened end 92. The curved body 88 may allow the installation of the secure hold hook 20 easier. In such embodiments, as the body 24 bends at the hinge 52 the curved body 88 of the fastener 76 may rotate in a generally arcuate path. This may allow insertion of the fastener 76 into the applicable surface easier for the user. The piercing end 92 may be of a configuration such that the user may be capable of inserting the piercing end 92 into a surface with little effort. The piercing end 92 may be of a configuration such that as the user begins to engage the applicable surface, the piercing end 92 may pierce the applicable surface with little effort required by the user. Once the piercing end 92 has pierced the surface to which the secure hold hook 20 is being attached, the curved body 88 may continue to be inserted into the surface. Upon such insertion, in addition to the adhesive 72 being attached with the surface, the secure hold hook 20 may be operatively attached with the surface. Further, the fastener 76 may be small such that the hole made in the surface to which the secure hold hook 20 attaches is very small and may be imperceptive to the user upon removal of the secure hold hook 20—which may result in the appropriate surface having little to no damage upon removal of the secure hold hook 20.

In operation, the user may determine the location on the particular surface to which the user desires to attach the secure hold hook 20. Once the user identifies the location, the user may remove the liner 75 from the second adhesive 74, i.e., the removable adhesive. The user may adhere the secure hold hook 20 with the applicable surface by adhering the adhesive 72 to the surface. The user may then grasp the grasping portion 48 and rotate the top portion 36 relative to the bottom portion 40 toward the applicable surface. The top portion 36 may rotate at the hinge 52. The user may continue to apply pressure until the piercing end 92 of the fastener 76 pierces the applicable surface. The user may continue to rotate the top portion 36 so that the curved body 88 may continue to be inserted into the applicable surface. The user may continue to apply force until second surface 32 of the top portion 36 engages or otherwise contacts the applicable surface—the secure hold hook 20 is operatively attached with the surface. The user may selectively secure to the hook 56 any appropriate item.

The user may remove the secure hold hook 20 from the surface to which it is attached by grasping the grasping portion 48. The user may pull the grasping portion 48 away from the surface and may pivot the top portion 36 downward at the hinge 52. The user may continue this motion until the fastener 76 is removed from the surface. The user may continue to pull the grasping portion 48 downward. The second adhesive 74 attached with the wall is removable. Accordingly, as the user pulls downward, the user may overcome the force of the second adhesive 74 and the second adhesive 74 may give way allowing removal of the remaining portion of the secure hold hook 20. It should be noted that the first adhesive 73 being a permanent adhesive results in the first adhesive 73 remaining operatively engaged with the second surface 32 of the body 24, i.e., the first adhesive 73 is configured to remain operatively engaged with the body 24 during removal of the secure hold hook 20. Further, once the secure hold hook 20 is removed from the applicable surface, the fastener 76 may be of a configuration to leave a very small to imperceptible hole on the applicable surface and the second adhesive 74 may be removed entirely from the applicable surface and may leave the applicable surface generally undamaged.

Additional embodiments of a secure hold hook according the present teachings are described below. In the descriptions, all of the details and components may not be fully described or shown. Rather, the features or components are described and, in some instances, differences with the above-described embodiments may be pointed out. Moreover, it should be appreciated that these additional embodiments may include elements or components utilized in the above-described embodiments although not shown or described. Thus, the descriptions of these additional embodiments are merely exemplary and not all-inclusive nor exclusive. Moreover, it should be appreciated that the features, components, elements and functionalities of the various embodiments may be combined or altered to achieve a desired secure hold hook without departing from the spirit and scope of the present teachings.

Figure 8:
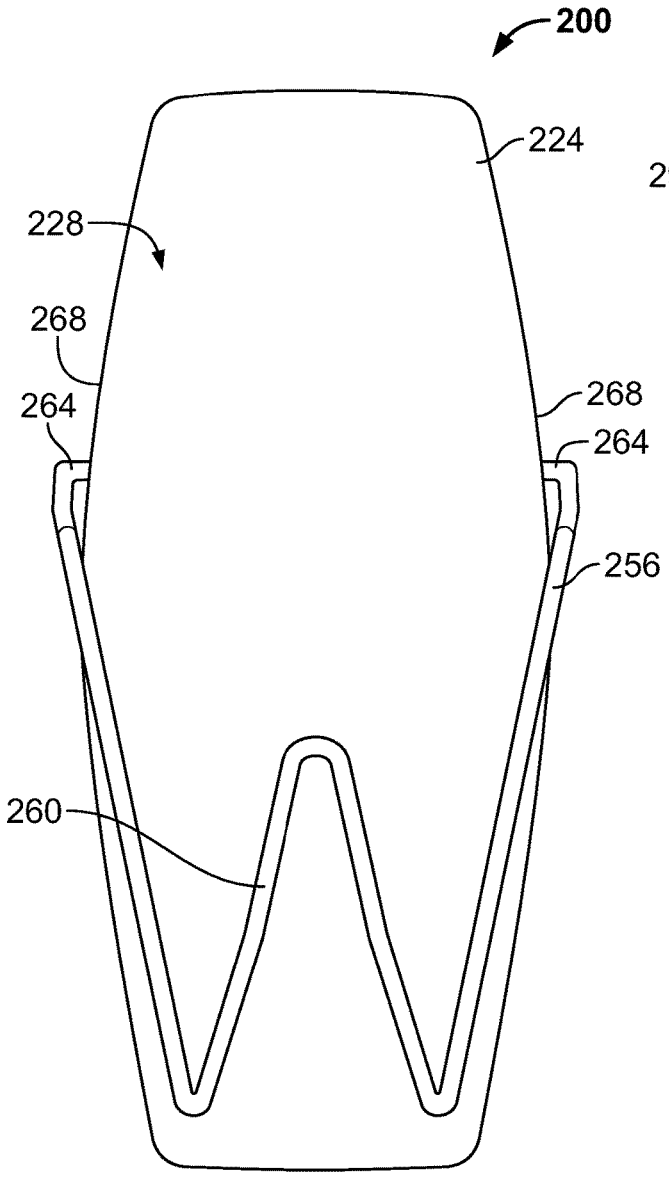
FIG. 8 is a front view of an embodiment of a secure hold hook.
Figure 9:
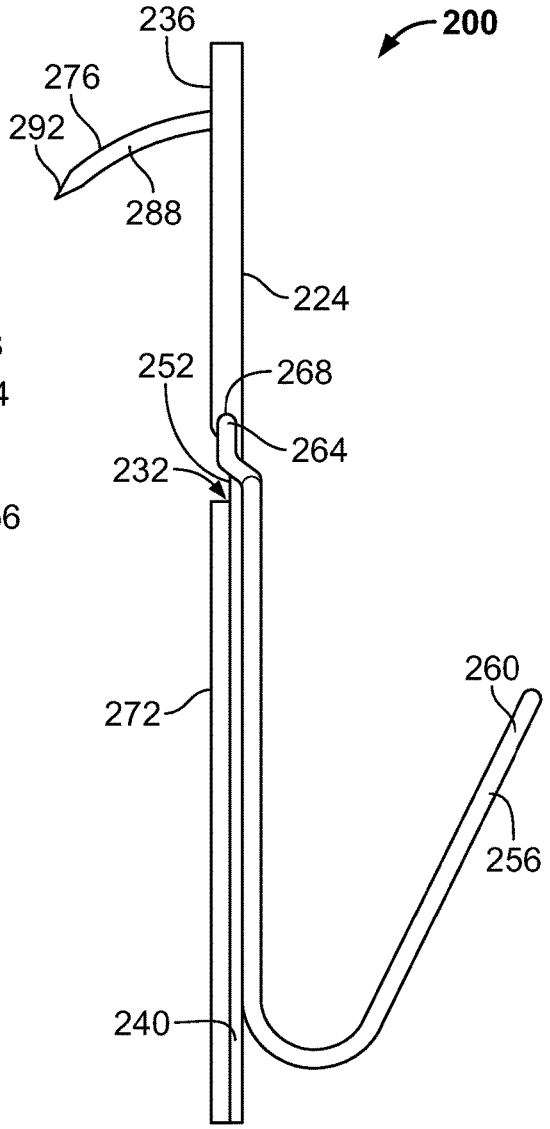
FIG. 9 is a side view of the secure hold hook of FIG. 8.

A secure hold hook 200 is shown in FIGS. 8 and 9. The secure hold hook 200 may be configured to be selectively attached to an applicable surface. The secure hold hook 200 may include a body 224. The body 224 may be of any appropriate shape and size and is not limited to that shown and described herein. The body 224 may include a first surface 228 and a second surface 232. The first surface 228 may be generally planar as shown in FIG. 8. The first surface 228 may extend outward when the secure hold hook 200 is operatively secured with the applicable surface. The body 224 may include a top portion 236 and a bottom portion 240 as shown in FIG. 9.

The secure hold hook 200 may include a hinge 252 that may be in any appropriate position on the body 224. The hinge 252 may be generally positioned between the top portion 236 and bottom portion 240 of the body 224. The hinge 252 may be any appropriate configuration such that the top portion 236 of the body 224 may pivot or bend relative to the bottom portion 240 of the body 224. By way of a non-limiting example, the hinge 252 may be a living hinge, i.e., it may be monolithically formed with the body 224. The hinge 252 may be thinner than either or both of the top 236 and bottom 240 portions of the body 224.

The secure hold hook 200 may include a hook 256 attached with side portions 268 of the body 224. The hook 256 may be of any appropriate configuration and is not limited to that shown and described. The hook 256 may be formed from a different material from that of the body 224. By way of a non-limiting example, the hook 256 may be formed from metal, such as steel, aluminum, or the like. The body 224 may be formed from a plastic or rubber material, such as polypropylene, polyethylene, and the like. The hook 256 may extend downward from the body 224 and may include a portion 260 that extends back toward the top portion 236 of the body 224. As shown, the hook 256 may be able to pivot with respect to the body 224. The hook 256 may be pivotally attached with the body 224 in any appropriate manner. By way of a non-limiting example, end portions 264 of the hook 256 may be inserted into the side portions 268 of the body 224 such that the hook 256 is capable of pivoting with respect to the body 224. Further, it should be understood in addition to the above, the hook 256 and body 224 may be formed of substantially the same material.

The secure hold hook 200 may include an adhesive 272 of any appropriate configuration, such as that described above. The adhesive 272 may be operatively attached with the second surface 232 at the bottom portion 240 of the body 224. The bottom portion 240 may be generally planar, which may provide a solid surface to which the adhesive 272 may adhere.

In some embodiments, the adhesive 272 may generally cover the entire bottom portion 240 of the second surface 232. In these embodiments, the adhesive 272 may extend from the bottom portion 240 to the hinge 252. In other embodiments, the adhesive 272 may generally cover a majority of the bottom portion 240 of the second surface 232 to the hinge 252—which may include any majority portion of the bottom portion 240.

Figure 9A:
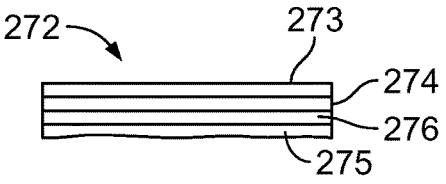
FIG. 9A is a side view of a portion of the adhesive of the secure hold hook of FIG. 8.
Figure 10:
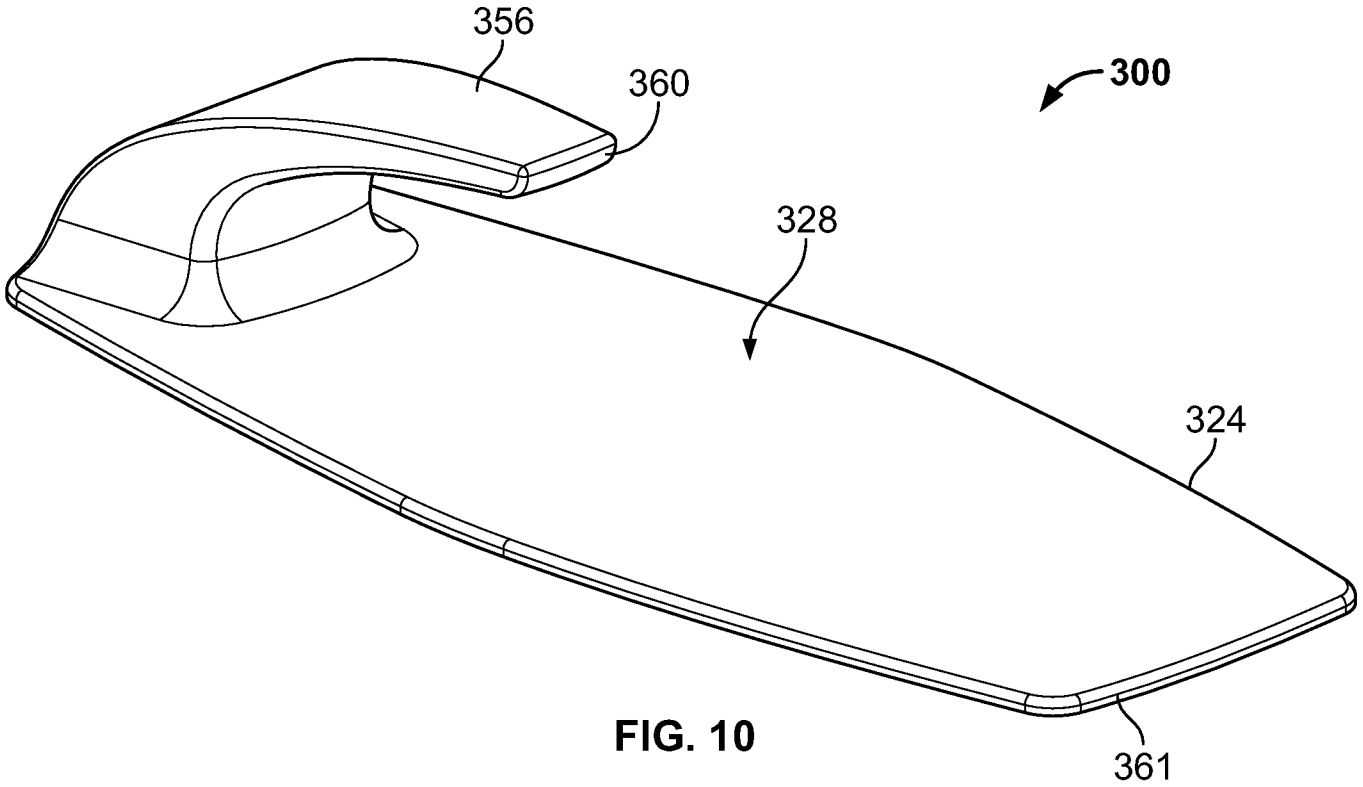
FIG. 10 is a perspective view of an embodiment of a secure hold hook.
Figure 11:
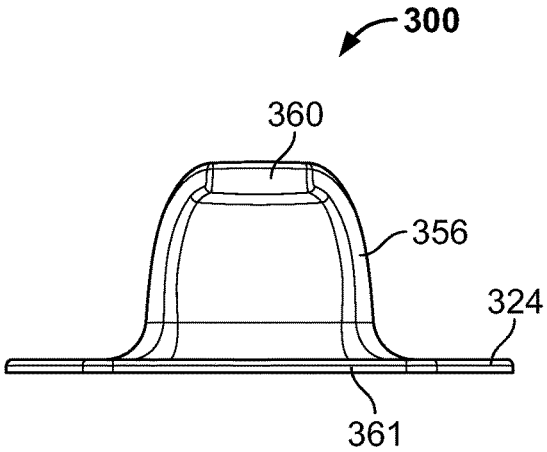
FIG. 11 is a top view of the secure hold hook.
Figure 12:
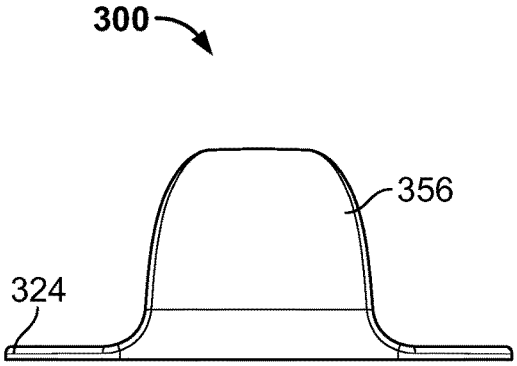
FIG. 12 is a bottom view of the secure hold hook.
Figure 13:
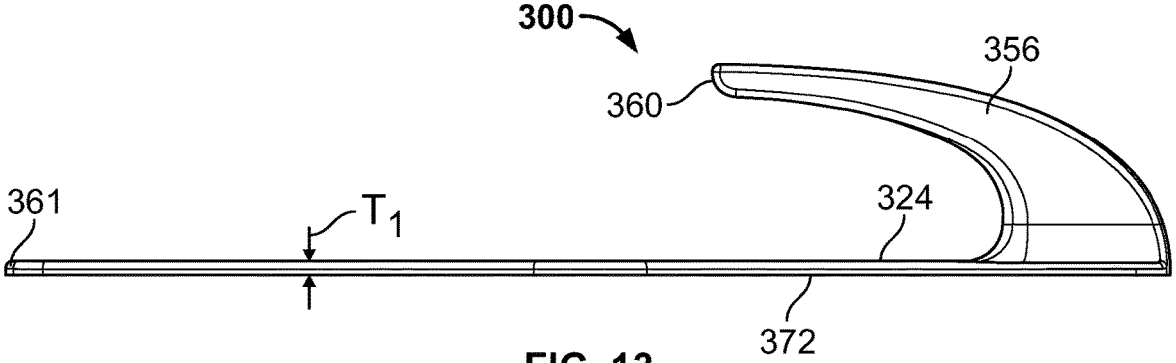
FIG. 13 is a first elevation view of the secure hold hook.
Figure 14:
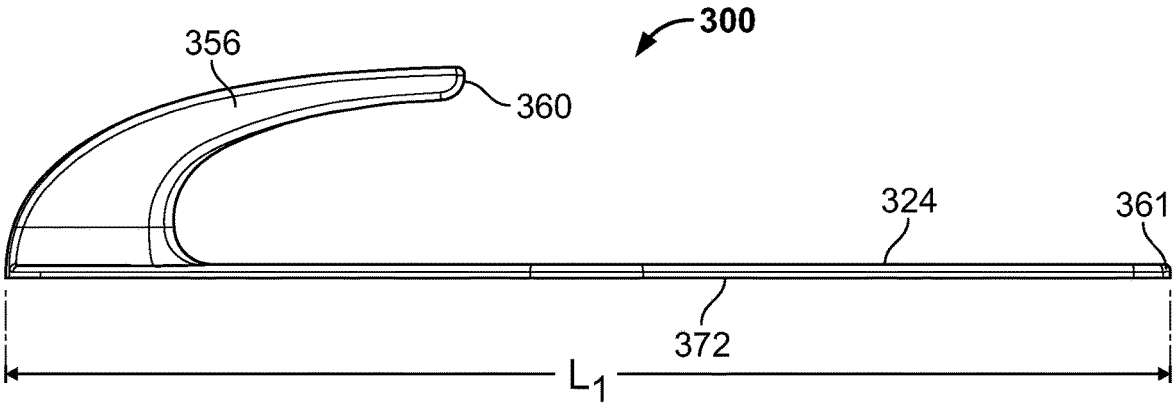
FIG. 14 is a second elevation view of the secure hold hook.
Figure 15:
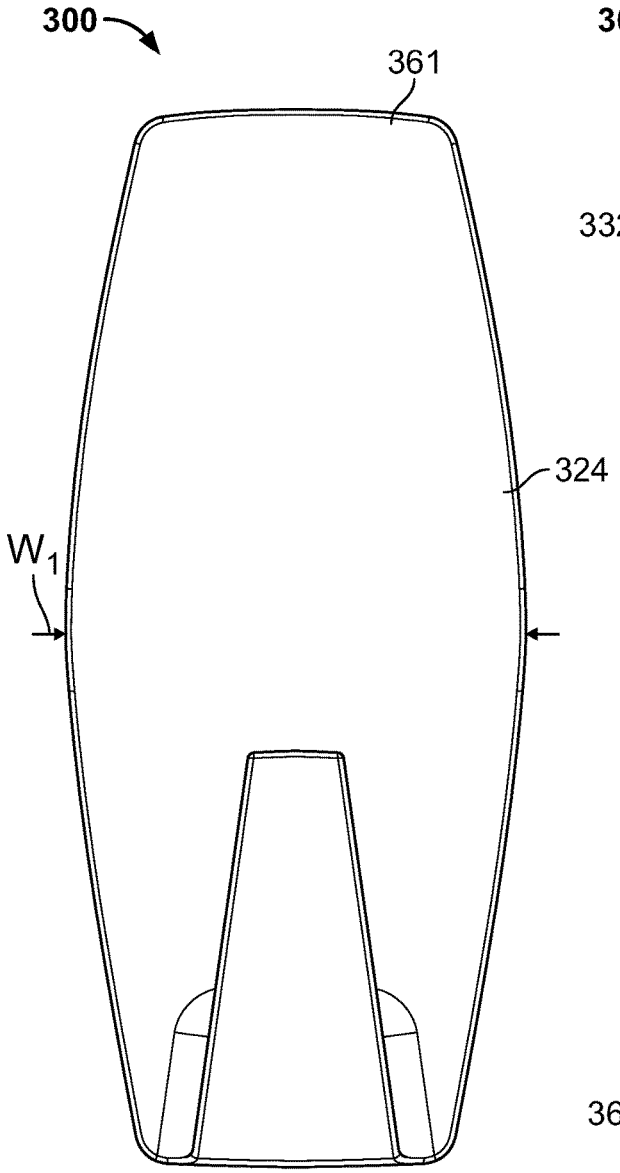
FIG. 15 is a front view of the secure hold hook.

The adhesive 272 may include a first adhesive 273 that operatively attaches with the second surface 232 of the body 224. This first adhesive 273 may be a permanent adhesive or may be a removable adhesive of any appropriate configuration/formulation, such as detailed above. The adhesive 272 may include a second adhesive 274 that may operatively attach with the applicable surface to which the secure hold hook 200 is attached. The second adhesive 274 may comprise a removable adhesive of any appropriate configuration/formulation. Further, the adhesive 272 may include a foam core 276 that may be generally positioned between the first and second adhesives 273, 274. The foam core 276 may be of any appropriate configuration and may be of any appropriate thickness. As shown in FIG. 9A, the foam core 276 may be sandwiched between the first and second adhesives 273, 274. Although while shown as being generally of even thickness, the first and second adhesives 273 and 274 along with the foam core 276 may be of any appropriate thickness, which may be of different thicknesses. By way of a non-limiting example, the adhesive 272 may include a double sided adhesive foam tape, which includes the first and second adhesive 273, 274 and the foam core 276.

Although, the present teachings are not limited to the above-identified configuration. In some embodiments, the first adhesive 273 may be a removable adhesive whereby the user may pull the body 224 from the first adhesive 273. In such embodiments, the user may then remove the adhesive 272 by overcoming the adhesive force of the second adhesive 274 from the applicable surface. A liner 275 may be removably attached with the second adhesive 274 to cover or otherwise protect the second adhesive 274 during non-use of the secure hold hook 200. The liner 275 may be of a configuration such that a user may pull or otherwise disengage the liner 275 from the second adhesive 274 during use. The liner 275 may be of any appropriate material. The second adhesive 274 may be configured to be cleanly removed from most hard, non-delaminating surfaces even after extended periods of time and in those embodiments in which the first adhesive 373 is a removable adhesive, it may be configured to be cleanly removed from most hard, non-delaminating surfaces even after extended periods of time.

The secure hold hook 200 may include an engaging member 276 configured to operatively secure a surface to which the secure hold hook 200 is attached. The engaging member 276 may provide an additional engaging feature in addition to the adhesive 272. The adhesive 272 in addition to the engaging member 276 may allow the secure hold hook 200 to be attached to a surface and withstand more forces than other prior art versions.

The engaging member 276 may be coupled with the body 224 in any appropriate manner. By way of a non-limiting example, the engaging member 276 may be operatively engaged with the top portion 236 and second surface 242 of the body 224 in any appropriate manner. As shown in FIG. 9, the engaging member 276 may include a fastener, such as a nail. A portion of the nail 276 may be inserted into the top portion 236 of the body 224. The nail 276 may include a generally curved body 288 and a piercing end 292, such as the generally sharpened end 292. The curved body 288 may allow the installation of the secure hold hook 200 easier. In such embodiments, as the body 224 bends at the hinge 256, the curved body 288 of the fastener 276 may rotate in a generally arcuate path. This may allow insertion of the nail 276 into the applicable surface easier for the user. The piercing end 292 may be of a configuration such that the user may be capable of inserting the piercing end 292 into a surface with little effort. Once the piercing end 292 has pierced the surface to which the secure hold hook 200 is being attached, the curved body 288 may continue to be inserted into the surface. Upon such insertion, in addition to the adhesive 272 being attached with the surface, the secure hold hook 200 may be operatively attached with the surface.

In other embodiments, such as shown in FIGS. 10-16, a secure hold hook 300 may be configured to be selectively attached to an applicable surface. The secure hold hook 300 may include a body 324. The body 324 may be of any appropriate shape and size, such as by way of a non-limiting example, being generally planar. The body 324 may be generally thin, i.e., it may have a thickness $T_1$ that is between approximately 0.03 and 0.07 inches. It should be understood, however, that the body 324 may be of any appropriate thickness and is not limited to that described herein.

The body 324 may be elongated such that it may be longer than it is wide, i.e., it may extend more longitudinally than it does laterally. However, the present teachings are not limited to this configuration. By way of a non-limiting example, the body 324 may be approximately 1.25 to 4 inches in length $L_1$ and may be approximately 0.5 to 1.75 inches in width $W_1$. It should be understood, however, that these dimensions are merely exemplary and the present teachings are not limited to the body 324 being of these dimensions.

Figure 16:
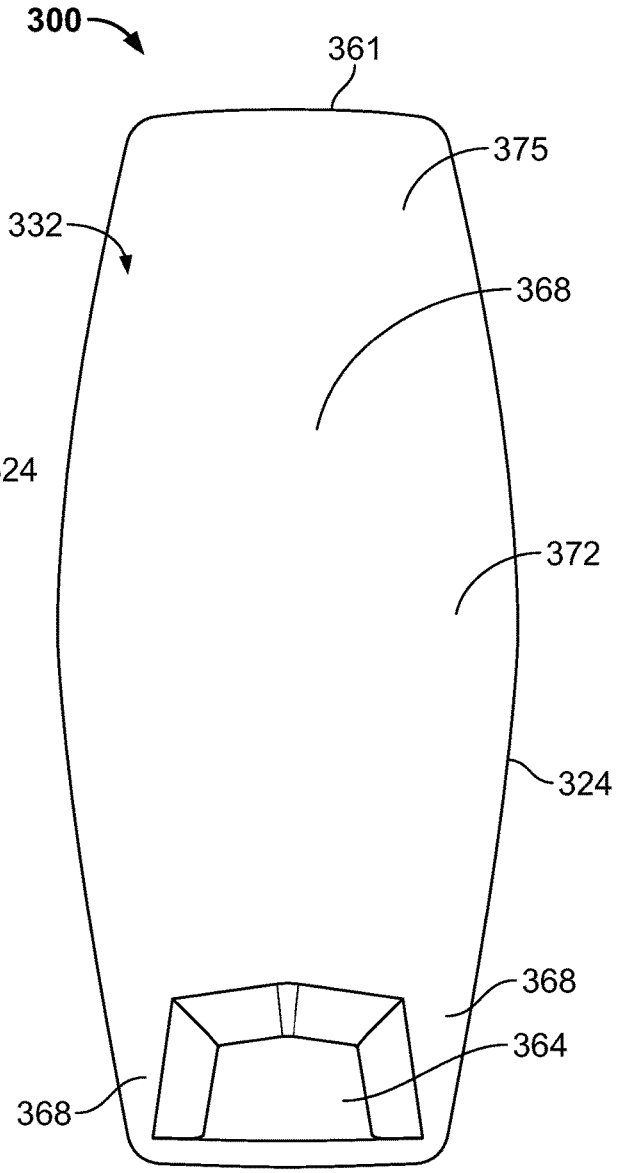
FIG. 16 is a rear view of the secure hold hook.
Figure 16A:
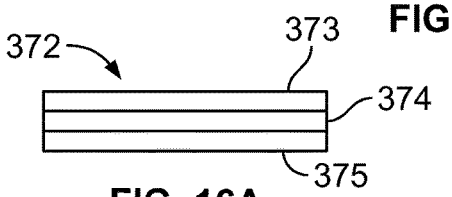
FIG. 16A is a side view of a portion of the adhesive of the secure hold hook of FIG. 10.

The body 324 may include a first surface 328 and a second surface 332. The first surface 328 may be generally planar as shown in FIG. 16. The first surface 328 may extend outward when the secure hold hook 300 is operatively secured with the applicable surface. The second surface 332 may extend inward toward the applicable surface with the secure hold hook 300 is operatively secured with the applicable surface.

The secure hold hook 300 may include a hook 356 extending from the first surface 328 of the body 324. The hook 356 may be of any appropriate configuration and is not limited to that shown and described. The hook 356 may be monolithically formed with the body 324 or may be attached through a subsequent process, e.g., welding, adhering or fastening. The hook 356 may extend toward a top portion 361 of the body 324. As shown, the hook 356 may extend approximately one-third to one-half of the length of the body 324. The hook 356 may be of a configuration to hold items on the secure hold hook 300. The hook 356 may be of a construction such that its width at the location from which it extends from the body 324 is substantially the majority of the width of the body 324. As shown, the width of the hook 356 at the location from which it extends from the body 324 may be between about 50% and 100% of the width of the body 324. The hook 356 may get extend generally upward and away from the first surface 328. The hook 356 may get thinner as it extends upward and away from the first surface 328. An end portion 360 of the hook 356 may be generally flat terminating end.

The hook 356 may be generally hollow. This may reduce the overall weight of the secure hold hook 300. The hook 356 may be of an overall thickness to handle an appropriate amount of weight of the item so attached during use to remain in an operative position on the applicable surface. Further, the hook 356 may not be hollow, but may include material of either or both of the body 324 and hook 356.

The hook 356 being generally hollow may result in a cavity 364 being formed in the second surface 332 of the body 324—the cavity 364 may reduce the overall weight of the secure hold hook 300 while generally maintaining its strength. The cavity 364 may extend into the hook 356. A generally planar portion 368 may generally circumscribe the cavity 364 as shown in FIG. 16. The generally planar portion 368 may provide a surface to which an adhesive may be attached with the second surface 332 of the body 324 as explained in more detail below.

The secure hold hook 300 may include an adhesive 372 of any appropriate configuration. The adhesive 372 may be operatively attached with the second surface 332 of the body 324. The adhesive 372 may generally circumscribe the cavity 364—the adhesive 372 may be operatively attached with the planar portion 368 of the second surface 332. The adhesive 372 being operatively attached with the planar portion 368 may provide a good adhesion to the body 324. This may further provide support to the secure hold hook 300. The planar portion 368 may provide a solid surface to which the adhesive 372 may adhere. Further, the planar portion 368 may similarly provide a solid surface to engage with the applicable surface to which the secure hold hook 300 is selectively attached.

In some embodiments, the adhesive 372 may generally cover the entire second surface 332. In these embodiments, the adhesive 372 may extend around the planar portion 368 and upwards covering the remaining portion of the second surface 332. In other embodiments, the adhesive 372 may generally cover a majority of the second surface 332—in such embodiments, the adhesive 372 may cover any majority portion of the second surface 332.

The adhesive 372 may include a first adhesive 373 that operatively attaches with the second surface 332 of the body 324. This first adhesive 373 may be a permanent adhesive or may be a removable adhesive of any appropriate configuration/formulation. The adhesive 372 may also include a second adhesive 374 that may operatively attach with the applicable surface to which the secure hold hook 300 is selectively attached. The second adhesive 374 may include a removable adhesive of any appropriate configuration/formulation. The adhesive 372 may include a foam core (not shown) positioned between the first and second adhesives 373, 374. By way of a non-limiting example, the adhesive 372 may include a double sided adhesive foam tape. The first adhesive 373 may comprise an extremely aggressive permanent adhesive on one side and the second adhesive 374 may comprise a removable adhesive on the other side. Although, the present teachings are not limited to this configuration. In some embodiments, the first adhesive 373 may be a removable adhesive whereby the user may pull the body 324 from the first adhesive 373. In such embodiments, the user may then remove the adhesive 372 by overcoming the adhesive force of the second adhesive 374 from the applicable surface. The removable side/second adhesive 374 may include a liner 375 configured to remove cleanly to expose the second adhesive 374 during attaching of the secure hold hook 300 to the applicable surface. The second adhesive 374 may be configured to be cleanly removed from most hard, non-delaminating surfaces even after extended periods of time—in those embodiments in which the first adhesive 373 is a removable adhesive, it may be configured to be cleanly removed from most hard, non-delaminating surfaces even after extended periods of time.

In use, a liner 375 may be attached with the second adhesive 374, the liner 375 generally preventing exposure of the second adhesive 374. The user may select a location on the applicable surface to which the secure hold hook 300 is to be secured. The user may remove the liner 375 from the second surface 374. The user may align the secure hold hook 300 in an operative position and adhere the secure hold hook 300 to the applicable surface.

In order to remove the secure hold hook 300, the user may grasp the secure hold hook 300 at or near the top portion thereof 361. The user may then pull downward on the secure hold hook 300. The user may need only to apply enough force to overcome the adhesion between the second adhesive 374 and the surface. In such embodiments, the permanent or first adhesive 373 may be stronger, which may generally prevent the permanent or first adhesive 373 from becoming disengaged from the second surface 332 of the body 324. Once the user has overcome the adhesion between the removable adhesive 373 and the surface, the user may remove the secure hold hook 300 from the surface. The adhesive 372 may be of a configuration that no damage occurs to the surface from which the secure hold hook 300 is removed.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof.

Having thus described the invention, the following is claimed:

1. A secure hold hook comprising:

a generally planar body having top and bottom portions and first and second opposed surfaces;

a hook monolithically formed with the body, the hook extending from the first opposed surface on the bottom portion, the hook having a cavity that is formed in the second opposed surface and extends into the hook;

a generally planar portion along the second opposed surface that circumscribes the cavity;

a double-sided adhesive attached with the second opposed surface; and wherein the double-sided adhesive includes a permanent adhesive secured with the second opposed surface and a removable adhesive extending from the permanent adhesive, the removable adhesive operatively secures the body to a surface and allows a user to pull downward on the top portion for removal of the body from the surface generally without damaging the surface.

2. The secure hold hook of claim 1, further comprising a hinge positioned between the first and second portions, the hinge configured to permit the first and second portions to pivot with respect to one another.

3. The secure hold hook of claim 1, wherein the decorative member comprises a thin membrane selectively and removably attached with the second opposed surface.

4. The secure hold hook of claim 3, wherein the decorative member includes a finished surface and an engaging surface, the engaging surface selectively and removably attached with the second opposed surface.

5. The secure hold hook of claim 4, wherein the finished surface includes a decorative finish.

6. The secure hold hook of claim 4, wherein the engaging surface includes a removable adhesive attached thereto the removable adhesive configured to be selectively removable from the second opposed surface of the body.

7. The secure hold hook of claim 4, wherein the engaging surface selectively and removably attaches with the second opposed surface of the body using static cling.

8. A secure hold hook comprising:

an elongated generally planar body having a top portion, bottom portion, and first and second surfaces;

a hook monolithically formed with the first surface of the body and extending from the first surface on the bottom portion, the hook extending at least one third of a length L of the body, the hook including a cavity that is formed in the second opposed surface and extends into the hook;

a generally planar portion along the second surface that circumscribes the cavity;

a double-sided adhesive attached with the second surface of the body to selectively attach to a surface;

wherein a width of the hook is 50-100% of a width of the body; and wherein said elongated generally planar body is configured to allow a user to selectively grasp the top portion and pull downward to remove the body from said surface generally without damaging the surface.

9. The secure hold hook of claim 8, wherein the double-sided adhesive includes a permanent adhesive secured with the second surface and a removable adhesive extending from the permanent adhesive.

10. The secure hold hook of claim 9, wherein the permanent adhesive is secured with the generally planar portion.

11. The secure hold hook of claim 9, wherein the removable adhesive operatively secures the body to a surface and allows removal of the body from the surface generally without damage.

12. The secure hold hook of claim 8, wherein the hook is generally hollow.

13. A secure hold hook comprising:

an elongated generally planar body having a top portion and a bottom portion with a thickness and a width and having first and second opposed surfaces; the thickness of the body is about 0.03 inches and 0.07 inches;

a hook monolithically formed with the first opposed surface on the bottom portion, the hook including a cavity that is formed in the second opposed surface and extends into the hook, wherein a width of the hook is about 50% to 100% of the width of the body;

a generally planar portion along the second opposed surface that circumscribes the cavity;

a double-sided adhesive attached with the second surface to selectively secure the body to a surface, wherein the double-sided adhesive includes a permanent adhesive secured with the second surface and a removable adhesive extending from the permanent adhesive; and wherein said elongated generally planar body is configured to allow a user to selectively grasp the top portion and pull downward to remove the body from said surface generally without damaging the surface.

14. The secure hold hook of claim 13, wherein the permanent adhesive is secured with the generally planar portion.

15. The secure hold hook of claim 14, wherein the removable adhesive operatively secures the body to a surface and allows removal of the body from the surface generally without damage.

16. The secure hold hook of claim 1 wherein the planar body is elongated such that it includes a length L that is between about 1.25 inches to 4 inches and a width W that is between about 0.5 inches to 1.75 inches.

17. The secure hold hook of claim 8 wherein the planar body includes a length L that is between about 1.25 inches to 4 inches and a width W that is between about 0.5 inches to 1.75 inches.

18. The secure hold hook of claim 13 wherein the planar body includes a length L that is between about 1.25 inches to 4 inches and a width W that is between about 0.5 inches to 1.75 inches.

* * * * *